United States Patent [19]

Wilkinson et al.

[11] Patent Number: 4,672,836

[45] Date of Patent: Jun. 16, 1987

[54] LOCK TAB WRENCH

[76] Inventors: Herbert C. Wilkinson, 4731 NE. 10 St.; Jesse A. Edsall, 3401 SE. 33rd Ct., both of Ocala, Fla. 32671

[21] Appl. No.: 851,535

[22] Filed: Apr. 14, 1986

[51] Int. Cl.[4] ..... B25B 1/06

[52] U.S. Cl. ..... 72/479; 72/458; 81/3.56; 81/176.3

[58] Field of Search ..... 72/458, 459, 479; 81/176.03, 176.15, 111, 3.55, 3.56, 3.57, 97

[56] References Cited

U.S. PATENT DOCUMENTS

| | | | |
|---|---|---|---|
| 915,861 | 3/1909 | Hunter et al. | 72/458 |
| 1,504,847 | 8/1924 | Tarr | 81/176.3 |
| 1,707,856 | 4/1929 | Hoffman | 81/176.3 |
| 2,373,210 | 4/1945 | Van Genderen | 81/176.15 |
| 2,462,387 | 2/1949 | Guffey et al. | 81/3.56 |
| 2,759,381 | 8/1956 | Villnave | 81/3.56 |
| 2,776,587 | 1/1957 | Killius | 72/458 |
| 3,148,567 | 8/1964 | Wood | 81/97 |
| 3,292,465 | 12/1966 | Mulligan | 81/176.3 |
| 3,908,438 | 9/1975 | Norden | 81/3.56 |

*Primary Examiner*—Robert L. Spruill
*Assistant Examiner*—David B. Jones
*Attorney, Agent, or Firm*—John M. Harrison

[57] ABSTRACT

A lock tab wrench for removing lock tabs from the shafts of outboard motors, which lock tab wrench includes a handle, a fulcrum extending from the underside of the handle, a threaded allen screw tip projecting from the fulcrum and a shaped hook pivotally mounted on the end of the handle opposite the fulcrum. The hook is provided with a projecting hook retainer at the extending end, which hook retainer is designed to engage the bent tabs on a lock tab seated on the propeller shaft inside the propeller hub and straighten the tabs in order to facilitate unthreading the shaft nut from the motor shaft.

10 Claims, 6 Drawing Figures

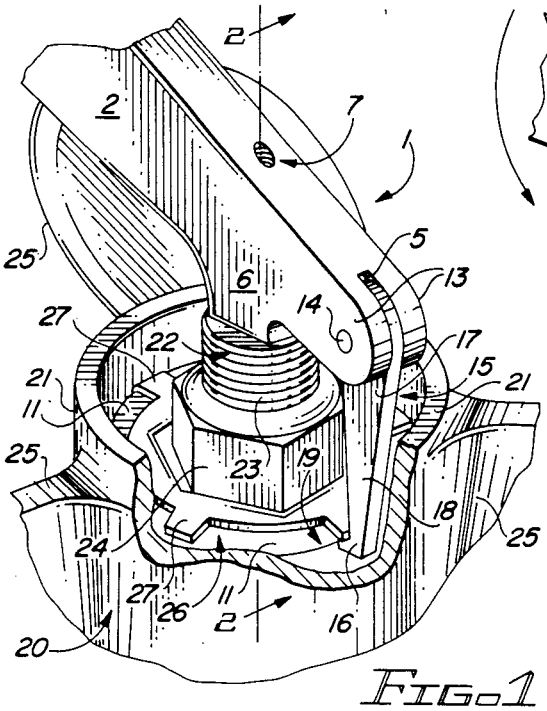
FIG. 1
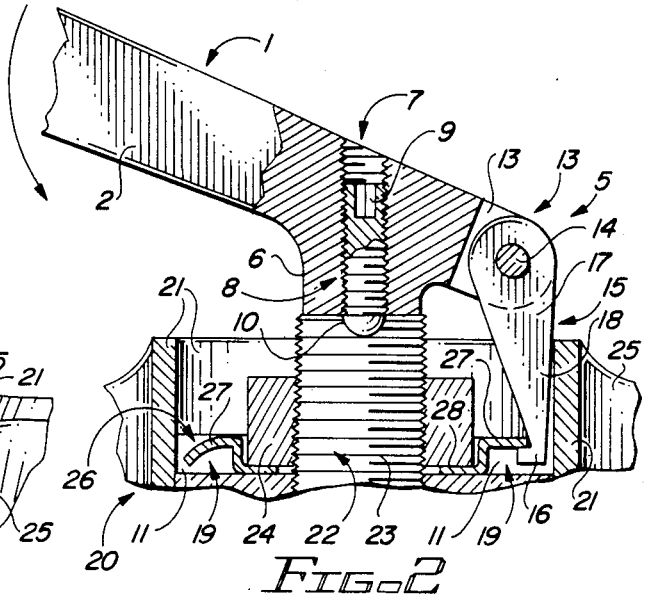
FIG. 2
FIG. 3
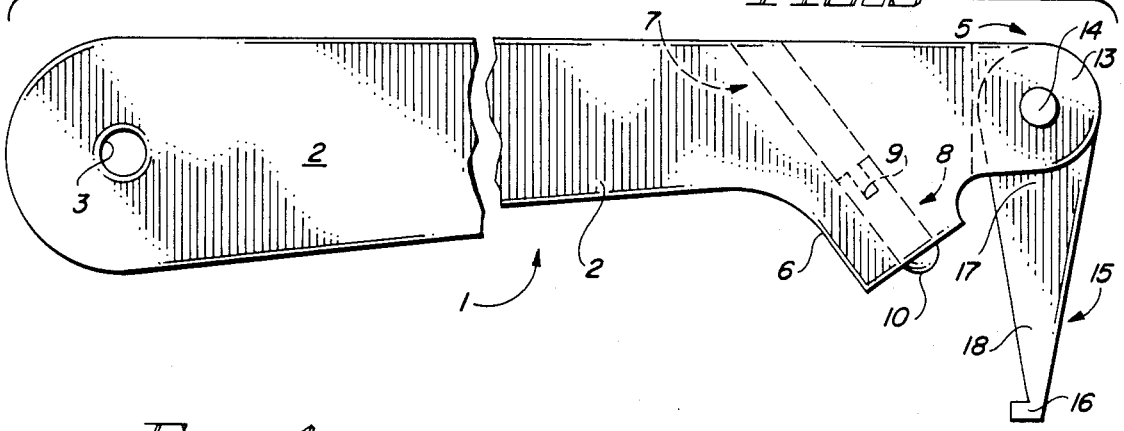
FIG. 4
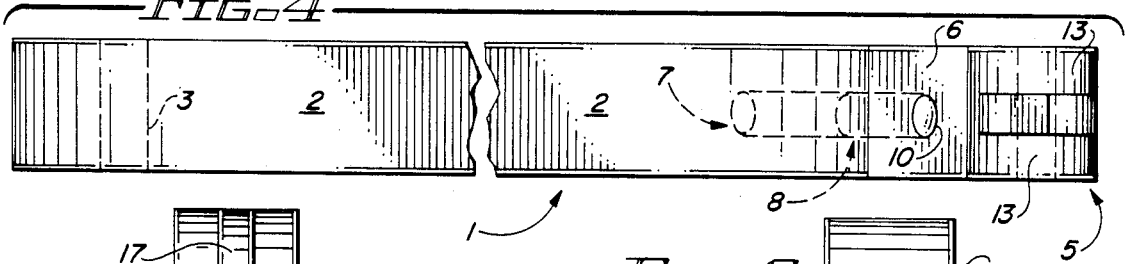
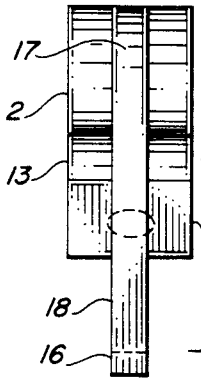
FIG. 5
FIG. 6
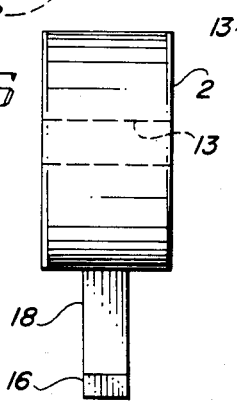

LOCK TAB WRENCH

BACKGROUND OF THE INVENTION

1. Field of Invention

This invention relates to specialty marine tools and more particularly, to a lock tab wrench which is designed to remove lock tabs from the propeller shafts of outboard motors such as "Mercury" outboard motors and specifically, "Mercury" outboard motors using the "Mercury V-6 Chopper" propeller. The lock tab wrench of this invention is designed to engage, bend and straighten individual tabs which are radially spaced on a lock tab seated in the propeller hub on the motor shaft for engaging and securing a nut on the shaft and the propeller on the lower unit of the motor. In a preferred embodiment the lock tab wrench includes an elongated handle, a fulcrum projecting from the underside of the handle with a threaded allen screw seated in the fulcrum and a hook pivotally mounted on the end of the handle opposite the fulcrum. A retainer projects from the extending end of the hook for engaging and bending the respective tabs on the lock tab. The lock tab wrench is designed to bend individual tabs upwardly to straighten the tabs when it is desired to remove the lock tab and shaft nut from the propeller shaft in order to facilitate unthreading the shaft nut and the lock tab from the shaft to remove the propeller from the shaft.

One of the problems associated with the use of outboard motors, as well as outboard motor units of the inboard-outboard design, is that of losing propellers due to inadvertant unthreading of the shaft nut from the motor shaft. This problem frequently occurs when the shaft nut is not tightly secured on the shaft and sometimes under circumstances where the propeller is being removed while the boat is in the water. Since propellers are expensive operational parts of an outboard motor, many thousands of dollars are lost annually due to the accidental loosening and unthreading of shaft nuts from companion propeller shafts. The problem is intensified under circumstances where the motor under consideration is a high speed "Mercury" motor, and particularly those motors which are used for racing applications, where the engine revolutions per minute are very high. The problem is apparent not only in large motors but also in motors used for small pleasure boats, as well as those used in boats of intermediate size, such as those used for towing activities like water skiing.

One attempt to eliminate the problem of inadvertant loosening of the retaining nut or shaft nut on a propeller shaft with the resulting loss of a propeller, is that of using a lock tab which is fitted over the propeller shaft and receives the lock nut in a shaped receptacle to prevent the nut from unthreading on the shaft. These lock tabs are typically used on "Mercury" outboard motors and "Mercury" inboard-outboard drive systems which utilize the "Mercury V-6 Chopper" propeller, and are characterized by a round plate having a hexagonal-shaped receptacle stamped therein to receive the retainer nut and multiple, outwardly-extending and radially disposed tabs projecting from the plate. The tabs are designed to bend downwardly into slots provided in a lock tab seat located in the propeller hub when the propeller, lock tab and shaft nut are tightened in functional position on the propeller shaft. When the tabs are bent into the slots and the shaft nut is securely seated in the hexagonal cavity, the shaft nut is prevented from unthreading on the shaft. Accordingly, the tabs must be bent upwardly, out of the slots, in order to clear the lock tab seat and allow the shaft nut to be unthreaded from the shaft to effect removal of the propeller from the shaft and from the lower unit of the motor. The lock tab awrench of this invention is designed to perform this function.

2. Description of the Prior Art

There are various types of specialty wrenches designed for a variety of specific functions known in the art. Typical of these tools is the "C-Spanner or Wrench For Slotted Nuts or Parts" disclosed in U.S. Pat. No. 1,504,847, dated Aug. 12, 1924, to H. S. Tarr. This wrench is designed to engage slotted nuts or slotted circular bodies and is characterized by a stationary jaw, to one end of which is pivoted a movable jaw terminating in a hook. The hook is designed to engage the slot in a slotted nut or part, while the opposite edge or side of the slotted nut or part rests against the fixed jaw. The slotted nut or part is subjected to a torque when pressure is applied to the fixed jaw. In an alternative embodiment, the fixed jaw and movable jaw are connected by several links of a chain to facilitate engaging larger slotted nuts or parts. U.S. Pat. No. 1,707,856, dated Apr. 2, 1929, to H. Hoffman, discloses a "Wrench" which is characterized by a handle having a notched end that is received in and pivoted to a lug-receiving slot on one end of a curved jaw. The other end of the jaw is provided with an opening for receiving an opposite lug on the handle. A spring-influenced latch is engagable with the socket for locking the jaw to the handle when the wrench is in coupling-engaging position. An opposite movement of the latch permits swinging of the handle and jaw to bring the wrench out of engagement with the coupling. A "Spanner Ratchet Wrench" is disclosed in U.S. Pat. No. 2,373,210, dated Apr. 10,1945, to G. Van Genderen. The Van Genderen "Spanner Ratchet Wrench" includes an elongated rod and a pair of plates secured to opposite faces of the rod adjacent one end of the rod to form a channel therebetween, with the plates extending downwardly from the rod and each plate having a longitudinal slot provided in the downwardly extending portion thereof. The upper edge of the plate defining each slot is characterized by a series of ratchet teeth and a second elongated rod having one end located within the channel and a transverse pin projecting through the end of the rod within the channel, is provided for coaction with the ratchet teeth. A transverse pin secured to the opposite free end of each of the rods connects the rods to a hook-shaped member for engaging a workpiece to be manipulated. U.S. Pat. No. 3,148,567, dated Sept. 15, 1964, to J. D. Wood, discloses a "Forced Multiplication Device". The device of this invention includes a lever having a fixed arcuate jaw, multiple gripping projections provided along the inner surface of the fixed jaw, with each of the gripping projections having a redial surface and a cam surface, A pair of projecting lugs is provided on the lever and a movable arcuate jaw is pivotally mounted on the projecting lugs in opposed relationship with respect to the fixed arcuate jaw. Multiple gripping projections provided along the inner surface of the movable arcuate jaw feature radial surfaces and cam surfaces, respectfully. The movable jaw is of sufficient length to permit an end portion thereof to swing inwardly of the free end of the fixed jaw. A spring normally biases the movable jaw toward the fixed jaw and the manipulating boss on one end of the movable jaw facilitates opening of the jaws when force is applied thereto. U.S. Pat. No. 3,292,465, dated Dec. 20, 1966, discloses a "Tie Rod Spanner" which is characterized by a rigid elongated handle having a fixed jaw provided on one end, with a plurality of outwardly-projecting teeth provided around the periphery of the jaw, which teeth are located at a substantially uniform distance from an axis transverse to the jaw. A movable jaw is pivotally connected to the fixed jaw and is designed to swing about the transverse axis, with the movable jaw having work-engaging means provided on the free end thereof.

It is an object of this invention to provide a new and improved marine specialty tool for aiding in the removal of shaft nuts and propellers from the motor shafts of outboard motors and inboard-outboard motor drive systems which utilize lock tabs to secure the shaft nuts on the motor shafts.

Another object of this invention is to provide a lock tab wrench which is designed to bend and straighten the bent tabs on a lock tab which retains the shaft nut on the shaft of a motor, in order to facilitate removel of the shaft nut from the shaft.

Still another object of this invention is to provide a lock tab wrench which is characterized by an elongated handle, a fulcrum extending from the handle and a hook projecting from one end of the handle opposite the fulcrum for engaging the tabs in a lock tab and bending the tabs to straighten the tabs and facilitate removal of the retaining or shaft nut and the propeller from a motor shaft.

A further object of this invention is to provide a new and improved lock tab wrench which is characterized by a flat, elongated handle, a fulcrum extending from the handle, with threaded adjustment means located in the fulcrum, and a hook pivotedly attached to one end of the handle opposite the fulcrum, the hook designed to engage and straighten the tabs on a lock tab to facilitate unthreading a shaft nut from an outboard motor shaft in order to remove the propeller from the shaft.

SUMMARY OF THE INVENTION

These and other objects of the invention are provided in a new and improved lock tab wrench which is characterized by flat, tapered, elongated handle having an outwardly-extending fulcrum with a threaded allen screw fitted therein and a hook pivotally attached to one end of the handle near the fulcrum, which hook is fitted with a retainer at the extending end for engaging the tabs on a lock tab used to lock a shaft nut on the propeller shaft of an outboard motor, in order to facilitate bending and straightening the tabs and freeing the shaft nut for unthreading from the shaft and removing the propeller from the shaft.

BRIEF DESCRIPTION OF THE DRAWING

The invention will be better understood by reference to the accompanying drawing, wherein:

FIG. 1 is a perspective view, partially in section, of the lock tab wrench of this invention in functional configuration engaging one of several tabs of a lock tab located in the hub of a propeller;

FIG. 2 is a sectional view taken along line 2—2 in FIG. 1, of the hub, propeller shaft, lock nut and lock tab illustrated in FIG. 1;

FIG. 3 is a side view, partially in section, of a preferred embodiment of the lock tab wrench of this invention;

FIG. 4 is a top view of the lock tab wrench illustrated in FIG. 3;

FIG. 5 is a front end view of the lock tab wrench illustrated in FIGS. 3 and 4; and FIG. 6 is a rear end view of the lock tab wrench illustrated in FIGS. 3–5.

DESCRIPTION OF THE PREFERRED EMBODIMENTS

Referring initially to FIGS. 3–6 of the drawings in a most preferred embodiment, the lock tab wrench of this invention is generally illustrated by reference numeral 1. The lock tab wrench 1 is characterized by an elongated handle 2, having a handle aperture 3 in one end for convenient location of the lock tab wrench 1 on a nail or other projection for storing purposes. The opposite end of the handle 2 is provided with a bifurcated head 5, defined by parpllel head plated 13, each of which has an opening (not illustrated) extending transversely therethrough. A bifurcation 12 is defined by the parallel head plates 13. The hook base 17 of a flat hook 15 extends between the head plates 13 into the bifurcation 12 in the bifurcated head 5, as illustrated. The hook base 17 is also provided with an opening (not illustrated) which registers with the transverse opening in the head plate 13 of the bifurcated head 5 and receives a pin 14, which operates to pivotally secure the hook 15 in the bifurcated head 5. In a preferred embodiment of the invention the hook 15 tapers from a maximum width at the hook base 17 to a minimum width at the hook foot 18, where a retainer 16 projects outwardly at an angle in the range of from about 80 to about 90 degrees with respect to the horizontal axis of the hook 15. A fulcrum 6 projects from the underside of the handle 2 at a point intermediate the ends of the handle 2 near the hook 15, as illustrated. In a most preferred embodiment of the invention the handle 2 is tapered and flat and the fulcrum 6 projects from the bottom edge of the narrow segment of the handle 2 at an angle toward the hook 15.

The fulcrum 6 is provided with a threaded bore 7, which extends through the fulcrum 6 and the handle 2 and opens at the top of the handle 3. An allen screw is generally represented by reference numeral 8 and is threadably disposed in the threaded bore 7, with the rounded allen screw tip 10 projecting outwardly of the threaded bore 7 and the fulcrum 6, as illustrated in FIG. 3. An allen screw seat 9 is provided in the end of the allen screw 8 opposite the allen screw tip 10, in order to facilitate adjustment of the allen screw 8 in the threaded bore 7 for purposes which will be hereinafter further described.

Referring now to FIGS. 1 and 2 of the drawing of the lock tab wrench 1 is designed for use in cooperation with a propeller 20 having a conventional propeller hub 21, seated on a threaded propeller shaft 22 which is driven by an engine (not illustrated). The propeller shaft 22 is fitted with conventional shaft threads 23 and a conventional shaft nut 24 is threaded on the shaft threads 23 in order to retain the propeller 20 on the propeller shaft 22. The propeller 20 is shaped to define multiple propeller blades 25, the number and configuration of which may vary. A iock tab seat 11 is seated or formed in the base of the propeller hub 21 and the propeller shaft 22 extends through the lock tab seat 11, parallel to the propeller hub 21. The lock tab seat 11 is provided with multiple seat slots 19 located in spaced relationship around the periphery of the lock tab seat 11, as illustrated. The lock tab 26 is provided with a central recess 28, which is hexagonally-shaped to receive the shaft nut 24 and includes an opening centered in the recess 28, to receive the propeller shaft 22. When the shaft nut 24 is seated in the recess 28, the shaft nut 24 can be threaded on the shaft threads 23 of the propeller shaft 22 and the lock tab 26 seated against the lock tab seat 11, as illustrated in FIGS. 1 and 2. The lock tab 26 is further provided with multiple tabs 27, which extend radially in spaced relationship from the body of the lock tab 26 and are designed to register with and bend downwardly into the seat slots 19 provided in the lock tab seat 11, when it is desired to secure the shaft nut 24, lock tab 26 and propeller 20 on the propeller shaft 22.

As further illustrated in FIGS. 1–6 of the drawing, when it is desired to remove the shaft nut 24 from the shaft threads 23 of a propeller shaft 22, the allen screw 8 is initially threadably adjusted in the threaded bore 7 of the fulcrum 6. This adjustment is effected by engaging the allen screw seat 9 with a conventional allem screw tool (not illustrated) and rotating the allen screw 8 until the desired length of allen screw tip 10 projects from the end of the fulcrum 6, as illustrated in FIGS. 2 and 3. The lock tab wrench 1 is then grasped by the handle 2 and the allen screw tip 10 is seated in a rexess (not illustrated) provided in the end of the propeller shaft 22, with the hook 15 projecting downwardly approximately parallel to the propeller hub 21. The retainer 16 is then manipulated beneath a selected one of the tabs 27 which has been bent downwardly in a companion seat slot 19 in the lock tab seat 11. Since in a preferred embodiment, the hook 15 is pivotally mounted at the hook base 17 between the head plates 13, the retainer 16 can be easily manipulated beneath the projecting edge of the selected tab 27 to engage the end of the tab 27. Pressure is then exerted downwardly on the opposite end of the handle 2, to exert an upward force on the tab 27 by engagement with the retainer 16. This action bends the tab 27 out of the seat slot 19, as illustrated in FIGS. 1 and 2 and straightens and disengages the tab 27 from the lock tab seat 11. This procedure is repeated for each of the tabs 27 located on the lock tab 26, until all of the tabs 27 are arranged in approximately parallel configuration with respect to the face of the lock tab seat 11, to the extent that none of the tabs 27 are projecting into companion seat slots 19 in the lock tab seat 11. Accordingly, the shaft nut 24 can then be unthreaded from the propeller shaft 22 by counterclockwise rotation using a conventional wrench, and the lock tab 26 is loosened and can be easily removed from the propeller shaft 22 as the shaft nut 24 is progressively unthreaded.

It will be appreciated by those skilled in the art that the lock tab wrench 1 of this invention is a convenient and useful tool for removing lock tabs from substantially any motor shaft, and marine shafts which accomodate the "Mercury V-6 Chopper" propeller in particular, for the purpose of removing propellers from such shafts. The lock tab wrench of ths invention can be used under any circumstances where it is desired to bend and straighten the tabs in a lock tab of substantially any design, in order to free the lock tab and a shaft nut for removal from a motor shaft. Referring again to the drawing, the lock tab wrench 1 can be adapted to quickly and easily remove a lock tab 26 located on a propeller shaft 22 or motor shaft of substantially any design, by adjustment of the allen screw 8 within the threaded bore 7 of the fulcrum 6, locating the allen screw tip 10 in the shaft recess, maneuvering the hook 15 and retainer 16 into the proper position and straightening each of the tabs 27, as described above. Furthermore, the lock tab wrench 1 can be constructed of a variety of materials such as aluminum, bronze, steel, and other materials known to those skilled in the art, depending upon specific needs.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A lock tab wrench for removing a lock tab from the shaft of a motor, said lock tab wrench comprising a handle; a fulcrum projecting from said handle; a threaded opening provided in said handle and said fulcrum; a bolt threadibly inserted in said threaded opening, said bolt having a rounded tip normally projecting from said fulcrum for engaging the shaft; receptacle means provided at the opposite end of said bolt for adjustment of said bolt in said threaded opening; and hook means carried by said handle, said hook means adapted for engagement with the lock tab and removal of the lock tab responsive to manipulation of said handle when fulcrum is positioned on the end of the shaft.

2. The lock tab wrench of claim 1 further comprising a bifurcation provided in said handle and wherein said hook means is pivotally disposed in said bifurcation.

3. The lock tab wrench of claim 1 wherein said hook means further comprises a tapered plate and a retainer projecting from the extending end of said tapered plate for engaging the lock tab.

4. The lock tab wrench of claim 3 further comprising a bifurcation provided in one end of said handle and wherein the wide end of said tapered plate is pivotally disposed in said bifurcation and said retainer projects from the narrow end of said tapered plate.

5. The lock tab wrench of claim 3 wherein said retainer projects from said narrow end of said tapered plate at an angle within the range of from about 80 degrees to about 90 degrees with respect to the longitudinal axis of said tapered plate.

6. A lock tab wrench for straightening bent tabs on a lock tab fitted on the propeller shaft of an outboard motor, said lock tab wrench comprising an elongated handle; a bifurcation provided on one end of said handle; a tapered hook having a wide end and a narrow end, said wide end of said hook pivotally mounted in said bifurcation; a fulcrum extending from said handle in angular relationship toward said hook; a threaded opening provided in said handle and said fulcrum; a bolt threadibly inserted in said threaded opening, said bolt having a rounded tip normally projecting from said fulcrum for engaging the shaft; and receptacle means provided at the opposite end of said bolt for adjustment of said bolt in said threaded opening, said narrow end of said hook adapted for engagement with the tabs respectively, for bending and straightening the tabs responsive to manipulation of said handle when said fulcrum is positioned on the end of the shaft.

7. The lock tab wrench of claim 6 further comprising a retainer projecting from said narrow end of said hook for engaging the tabs.

8. The lock tab wrench of claim 7 wherein said a retainer projects from said narrow end of said hook at an angle within the range of from about 80 degrees to about 90 degrees to the longitudinal axis of said hook.

9. A lock tab wrench for straightening tabs on a lock tab which is fitted on the propeller shaft of an outboard motor, with the tabs bent to secure a lock nut on the propeller shaft, said lock tab wrench comprising;

(a) an elongated, narrow, tapered handle shaped to define a grip at one end and a bifurcation provided at the opposite end;

(b) a tapered hook having a free narrow end and a wide end provided in registration with said bifurcation and a pin projecting transversely through said opposite end of said handle and through said wide end of said hook for pivotally mounting said hook to said opposite end of said handle;

(c) a retainer projecting from said narrow end of said hook in angular relationship;

(d) a fulcrum projecting from said handle in angular relationship intermediate said one end and said opposite end of said handle, said fulcrum substantially facing said hook, whereby said retainer is located beneath the tabs on the lock tab for bending the tabs into a straight configuration responsive to positioning said fulcrum on the end of the propeller shaft and manipulating said handle; and (e) a threaded opening provided in said handle and said fulcrum; a bolt threadibly inserted in said threaded opening, said bolt having a rounded tip normally projecting from said fulcrum for engaging the shaft; and receptacle means provided at the opposite end of said bolt for adjustment of said bolt in said threaded opening.

10. The lock tab wrench of claim 9 wherein said retainer projects from said narrow end of said tapered hook at an angle within the range of from about 80 degrees to about 90 degrees with respect to the longitudinal axis of said tapered hook.

* * * * *